United States Patent [19]

Bostian

[11] Patent Number: 4,539,726

[45] Date of Patent: Sep. 10, 1985

[54] SPRING BIASED PROP FOR A PIVOTED DOOR MEMBER

[75] Inventor: Bruce R. Bostian, Bristol, Ind.

[73] Assignee: Jedco, Inc., Elkhart, Ind.

[21] Appl. No.: 377,559

[22] Filed: May 12, 1982

[51] Int. Cl.[3] ..... E05F 1/14

[52] U.S. Cl. ..... 16/72; 16/366; 16/386

[58] Field of Search ..... 16/50, 65, 72, 80, 85, 16/365, 366, 386; 49/386

[56] References Cited

U.S. PATENT DOCUMENTS

| | | | |
|---|---|---|---|
| 1,189,963 | 7/1916 | Jones | 16/72 X |
| 1,628,826 | 5/1927 | Covalence | 16/85 |
| 3,891,111 | 6/1975 | Snazuk | 16/72 X |
| 4,034,438 | 7/1977 | Csokary et al. | 16/85 |
| 4,069,547 | 1/1978 | Guionie et al. | 16/85 X |

*Primary Examiner*—Fred A. Silverberg
*Attorney, Agent, or Firm*—Barnes & Thornburg

[57] ABSTRACT

A spring actuated door opening and closing assist device is disclosed which comprises first and second tubular members positioned in telescoping relationship. Each of the tubular members has a hole formed therein in a direction transverse to the centerline of the telescoping members for receiving a shaft of a support bracket for door closing apparatus. A coil spring is located within the telescoping tubular members and extends between the respective holes in the members. The holes are bounded by internally flared portions of the surrounding tubular member which provide bearing surfaces for the shafts of the support brackets and provide abutments for the ends of the coil spring whereby the operation of the device is relatively smooth and quiet and yet the device can be relatively inexpensively manufactured.

6 Claims, 7 Drawing Figures

SPRING BIASED PROP FOR A PIVOTED DOOR MEMBER

BACKGROUND AND SUMMARY OF THE INVENTION

The present invention relates to a spring actuated door opening and closing assist device, such as would be used on an automotive hood or trunk lid or on the lift type door commonly used on pick-up truck caps.

A known device of this type includes female and male telescoping tubes within which a coil spring is located. The ends of the coil spring in this known device act directly upon the shafts of L-shaped supporting brackets which are mounted within holes which extend in a direction transverse to the longitudinal center line of the telescoping tubes. This known arrangement is disadvantageous because it can result in noisy and irregular operation of the device.

An object of the present invention is to provide an improved spring actuated door opening and closing assist device which avoids these disadvantages associated with the known device. In particular, an object of the present invention is to provide a spring actuated door opening and closing assist device wherein the movement of the telescoping tubes of the device is smooth so that the operation of the device is regular and relatively quiet.

A further object of the present invention is to provide a spring actuated door opening and closing assist device of the type described which overcomes the disadvantages of the known device without substantially increasing the cost of the device.

These and other objects of the present invention are attained by providing a spring actuated door opening and closing assist device comprising first and second tubular members positioned in telescoping relationship, each of the tubular members having a hole formed therein in a direction transverse to the centerline of the telescoping tubular members for receiving a shaft of a support means for door closure means, a coil spring located within the telescoping tubular members and extending between the respective holes in the tubular members, and wherein at least one of the holes is bounded by internally flared portions of the surrounding tubular member which provide bearing surfaces for the shaft of the support means and which provide an abutment for an end of the coil spring.

According to a disclosed preferred embodiment of the invention, both of the holes in the tubular members are bounded by internally flared portions of the surrounding tubular members so as to provide bearing surfaces for the shafts of the support means and provide abutments for the ends of the coil spring. The holes are elongated in the direction of the centerline of the telescoping tubular members to permit relative movement between the shafts of the support means and the tubular members for smooth operation of the device.

The shafts of the respective support means have a round configuration and extend through the holes of the tubular members and means are provided for retaining the shafts in the holes. The means for retaining the shafts in the holes include enlarged portions of the support means adjacent the shafts. Cupped washers are provided on the shafts between the tubular members and the adjacent enlarged portions on the support means to assist in retaining the shafts in the holes.

These and other objects, features and advantages of the present invention will become more apparent from the following description when taken in connection with the accompanying drawings which show, for purposes of illustration only, one embodiment in accordance with the present invention.

DETAILED DESCRIPTION OF THE INVENTION

Figure 1:
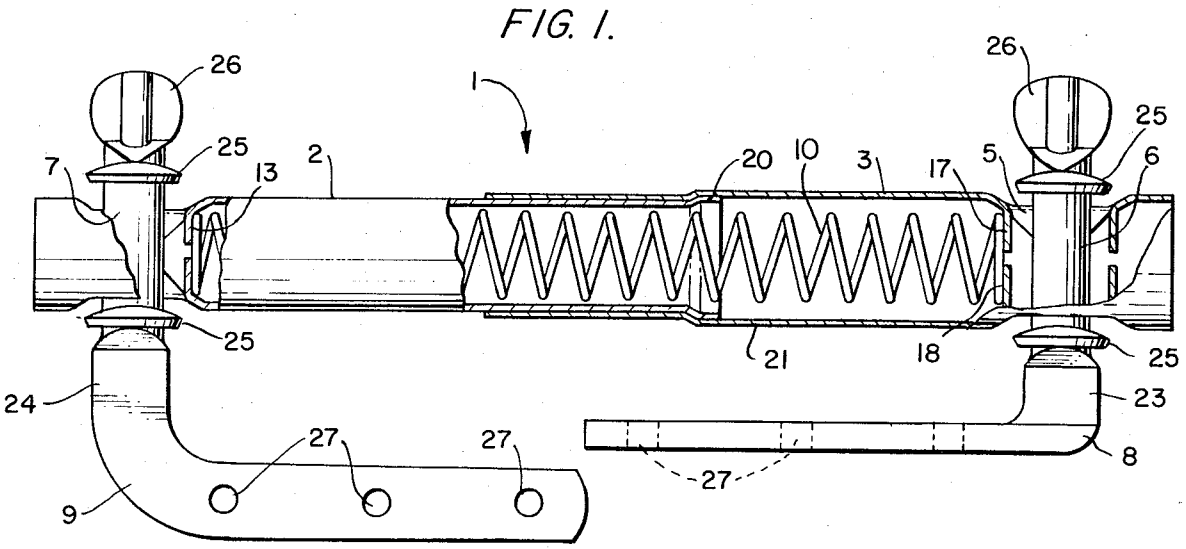
FIG. 1 is a side view, partially in cross section of a spring actuated door opening and closing assist device according to a preferred embodiment of the invention.
Figure 2:
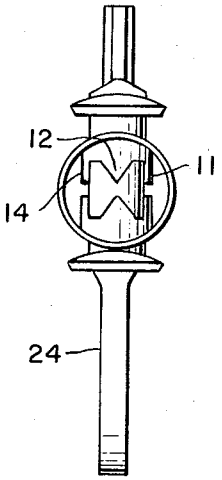
FIG. 2 is an end view of the left end of the spring actuated door opening and closing assist device of FIG. 1.
Figure 3:
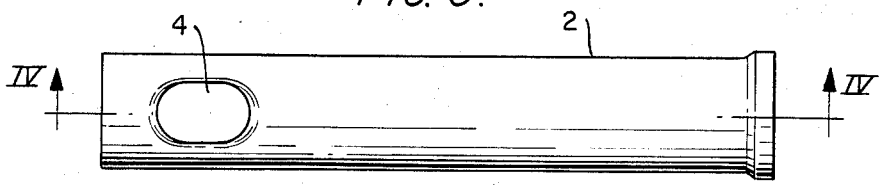
FIG. 3 is a top view of one of the tubular members of the device of FIG. 1 showing the hole formed through the tubular member.
Figure 4:
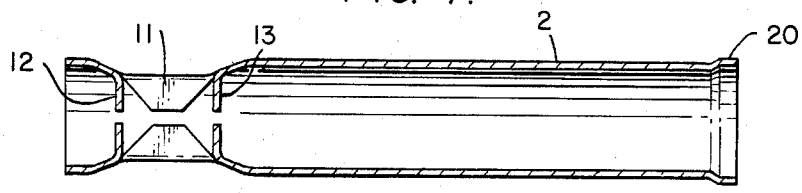
FIG. 4 is a cross sectional view of the tubular member of FIG. 3 taken along the line 4—4.
Figure 5:
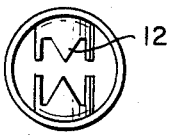
FIG. 5 is an end view of the right end of the tubular member shown in FIG. 3.
Figure 6:
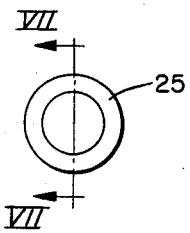
FIG. 6 is a top view of a washer for holding an L-shaped supporting bracket in a hole of a tubular member of the device illustrated in FIG. 1.
Figure 7:
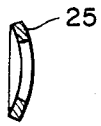
FIG. 7 is a cross sectional view of the washer of FIG. 6 taken along the line 7—7.

Referring now to the drawings, a spring actuated door opening and closing assist device 1 of the present invention is illustrated in FIG. 1. The device 1 comprises first and second tubular members 2 and 3 positioned in telescoping relationship so that one member may slide relative to the other along the longitudinal center line of the telescoping tubular members. Holes 4 and 5 are respectively formed in the tubular members in a direction transverse to the centerline of the telescoping members.

The holes 4 and 5, respectively receive the round shaft portions 6 and 7 of L-shaped support brackets 8 and 9 which, in turn, support the door closure apparatus, not shown. The door closure apparatus may be connected to the brackets 8 and 9 by means of suitable fasteners through holes 27 in the support brackets. A coil spring 10 is located within the telescoping tubular members 2 and 3 and extends between the respective holes 4 and 5 in the members.

The holes 4 and 5 are formed by piercing each of the tubes on opposite sides to form internally flared portions of the type shown at 11-14. These flared portions project inwardly from each side of the tubular member about the hole and provide bearing surfaces for the shafts 6 and 7 of the L-shaped support brackets 8 and 9 and also provide abutments for the ends of the coil spring 10.

The holes 4 and 5 are elongated in the direction of the longitudinal center line of the telescoping tubular members so as to permit relative movement between the round shafts 6 and 7 of the support brackets 8 and 9 and the adjacent tubular members for smooth operation of the device. As a result of this arrangement and the fact that the ends of the coil spring 10 abut against respective internally flared portions of the tubular members and not directly against the shafts 6 and 7 of the support brackets, the operation of the device of the invention is smoother and more regular as well as less noisy as compared with the known spring actuated door opening and closing assist device referred to above.

The tubular members 2 and 3 are preferably formed from cold rolled steel tubing with a wall thickness of approximately 0.025" for example. A bright zinc protective finish is provided on the outside of the tubular members. Each of the tubular members has a length of from approximately 6 to 10 inches and a diameter of approximately ¾ of an inch. The tubular member 2 is provided with a relatively short, larger diameter or expanded portion 20 which slidably fits within the relatively longer large diameter portion 21 of tubular member 3. The tubular member 2 is slightly smaller in diameter than the tubular member 3 so that the tubular members 2 and 3 can be telescoped to slide relative to one another in the arrangement illustrated in FIG. 1. This sliding movement is limited in one direction by the interaction of the enlarged portion 20 of tubular member 2 with the relatively smaller diameter portion of the tubular member 3 which is formed by swedging down tubular member 3 adjacent the enlarged portion 21 as shown in FIG. 1. Movement of the tubular member 2 within member 3 is limited in the other direction by the internally flared portions 17 and 18 of the tubular member 3 about the hole 5. The tubular member 3 is pierced from opposing sides to form the hole 5 after the members 2 and 3 have been positioned in telescoping relationship. In order to control the configuration of the internally flared portions, a piercing tool with relatively sharp leading edges may be employed to score or cut the surface of the tubular members during piercing. Alternatively, the tubular surface could be scored in a separate operation prior to piercing. Before the second of the holes 4 and 5 is formed the coil spring 10 is positioned within the tubular members. Once both holes 4 and 5 have been formed, the coil spring is confined within the tubular members by the flared portions of the tubular members about the holes.

The L-shaped supporting brackets 8 and 9 are formed of 6063T5 aluminum alloy. Adjacent the round shaft portions 6 and 7 of the brackets are flat, relatively wide portions 23 and 24. In assembling the device, the round shaft portions 6 and 7 of the brackets are placed through the holes 4 and 5 in the tubular members as shown in FIG. 1. Curved washers 25 of zinc plated cold rolled steel are positioned on the round shafts on either sides of the tubular members. The outer ends of the round shaft portions 6 and 7 are deformed under pressure after assembly to a heart-shaped key 26 which retains the adjacent washer 25 on the shaft. The washers 25 have an outside diameter greater than at least the width of the elongated holes so that the washers, in cooperation with the adjacent enlarged portions on the brackets, limit the relative movement of the round shafts within the holes in the tubular members.

As a result of the arrangement of the present invention, a spring actuated door opening and closing assist device is provided which can be smoothly operated in a relatively quiet manner. Moreover, the device of the invention can be manufactured relatively inexpensively.

While I have shown and described only one embodiment in accordance with the present invention, it is understood that the same is not limited thereto, but is susceptible to numerous changes and modifications as known to those skilled in the art, and I therefore do not wish to be limited to the details shown and described herein, but intend to cover all such changes and modifications as are encompassed by the scope of the appended claims.

I claim:

1. A spring actuated door opening and closing assist device comprising first and second tubular members positioned in telescoping relationship, each of said tubular members having a hole formed therein in a direction transverse to a centerline of the telescoping tubular members for receiving a shaft of a support means for door closure means, a coil spring located within said telescoping tubular members and extending between the respective holes in said tubular members, and wherein at least one of said holes is bounded by internally flared portions of the tubular member through which said one hole extends said flared portions providing both bearing surfaces for the shaft of the support means and an abutment for each end of said coiled spring, and wherein said holes are elongated in the direction of the centerline of the telescoping tubular members to permit relative movement between the shafts of the support means and the tubular members in the direction of the centerline of the telescoping tubular members for smooth operation of said device.

2. A spring actuated door opening and closing assist device comprising:

a first tubular member having a first transverse hole therethrough adjacent one end thereof, a second tubular member telescopically guided over said first tubular member and having a second transverse hole therethrough, first shaft means extended through said first transverse hole and connected for pivotal supporting movement at bearing surfaces at the first tubular member, said first shaft means including attaching means for accommodating detachable attachment of said shaft means to one of a fixed structure and a door, second shaft means extended through said second transverse hole and connected for pivotal supporting movement at bearing surfaces of the second tubular member, said second shaft means including attaching means for accommodating detachable attachment of said shaft means to the other one of the fixed structure and a door, spring means continuously biasing said first and second tubular members away from one another, said spring means engaging abutment means provided at the respective tubular members, and wherein at least one of said first and second transverse holes is bounded by flared portions of the tubular member surrounding said at least one hole, said flared portions forming both the bearing surfaces and the abutment means at the respective tubular member, and at least one of said transverse holes being elongated in a direction parallel to a longitudinal centerline of the tubular members to accommodate relative movement between the respective shaft means and the tubular members along said longitudinal centerline for smooth operation of said device.

3. A spring actuated door opening and closing assist device comprising:

a first tubular member having a first transverse hole therethrough adjacent one end thereof, a second tubular member telescopically guided over said first tubular member and having a second transverse hole therethrough, first shaft means extending through said first transvere hole and connected for pivotal supporting movement at bearing surfaces at the first tubular member, said first shaft means including attaching means for accommodating detachable attachment of said shaft means to one of a fixed structure and a door, second shaft means extended through said second transverse hole and connected for pivotal supporting movement at bearing surfaces of the second tubular member, said second shaft means including attaching means for accommodating detachable attachment of said shaft means to the other one of the fixed structure and a door, spring means continuously biasing said first and second tubular members away from one another, said spring means engaging abutment means provided at the respective tubular members, and wherein at least one of said first and second transverse holes is bounded by flared portions of the tubular member surrounding said at least one hole, said flared portions forming both the bearing surfaces and abutment means at the respective tubular member, said spring means being continuously in compression during use of said device with said shaft means in position in the respective transverse openings, and wherein said tubular members include respective facing flared portions which limit the telescoping movement of the tubular members with respect to one another, and at least one of said transverse holes being elongated in a direction parallel to the relative telescoping movement direction of the pivotal members to accommodate relative movement between the respective shaft means and the tubular members in the direction parallel to the relative telescoping movement direction for smooth operation of said device.

4. A spring actuated door opening and closing assist device comprising:

a first tubular member having a first transverse hole therethrough adjacent one end thereof, a second tubular member telescopically guided over said first tubular member and having a second transverse hole therethrough, first shaft means extending through said first transvere hole and connected for pivotal supporting movement at bearing surfaces at the first tubular member, said first shaft means including attaching means for accommodating detachable attachment of said shaft means to one of a fixed structure and a door, second shaft means extended through said second transverse hole and connected for pivotal supporting movement at bearing surfaces of the second tubular member, said second shaft means including attaching means for accommodating detachable attachment of said shaft means to the other one of the fixed structure and a door, spring means continuously biasing said first and second tubular members away from one another, said spring means engaging abutment means provided at the respective tubular members, and wherein at least one of said first and second transverse holes is bounded by flared portions of the tubular member surrounding said at least one hole, said flared portions forming both the bearing surfaces and abutment means at the respective tubular member, said abutment means between the spring and the respective tubular members being configured so as to permit relative free movement of the tubular member abutment means in one direction away from the spring means, whereby the spring means acts in only one axial direction of the tubular members, the tubular members being cylindrical in shape to permit relative rotational movement with respect to one another to further facilitate smooth operation of said device, and at least one of said transverse holes being elongated in a direction parallel to the relative telescoping movement direction of the pivotal members to accommodate relative movement between the respective shaft means and the tubular members in the direction parallel to the relative telescoping movement direction for smooth operation of said device.

5. A spring actuated door opening and closing assist device comprising:

a first tubular member having a first transverse hole therethrough adjacent one end thereof, a second tubular member telescopically over said first tubular member and having a second transverse hole therethrough, first shaft means extended through said first transverse hole and connected for pivotal supporting movement at bearing surfaces at the first tubular member, said first shaft means including attaching means for accommodating detachable attachment of said shaft means to one of a fixed structure and a door, second shaft means extended through said second transverse hole and connected for pivotal supporting movement at bearing surfaces of the second tubular member, said second shaft means including attaching means for accommodating detachable attachment of said shaft means to the other one of the fixed structure and a door, spring means continuously biasing said first and second tubular members away from one another, said spring means engaging abutment means provided at the respective tubular members, and wherein said first and second transverse holes are bounded by flared portions of the tubular member surrounding each of said holes, said flared portions form both the bearing surfaces and the abutment means at the respective tubular member, and wherein at least one of said transverse holes is elongated in a direction parallel to a longitudinal center line of the tubular members to accommodate a relative movement between the respective shaft means and the tubular members along the longitudinal center line for a smooth operation of said device.

6. A spring actuated door opening and closing assist device comprising:

a first tubular member having a first transverse hole therethrough adjacent one end thereof, a second tubular member telescopically over said first tubular member and having a second transverse hole therethrough, first shaft means extended through said first transverse hole and connected for pivotal movement supporting movement at bearing surfaces at the first tubular member, said first shaft means including attaching means for accommodating detachable attachment of said shaft means to one of a fixed structure and a door, second shaft means extended through said second transverse hole and connected for pivotal supporting movement at bearing surfaces of the second tubular member, said second shaft means including attaching means for accommodating detachable attachment of said shaft means to the other one of the fixed structure and a door, spring means continuously biasing said first and second tubular members away from one another, said spring means engaging abutment means provided at the respective tubular members, and wherein said first and second transverse holes are bounded by flared portions of the tubular member surrounding each of said holes, said flared portions form both the bearing surfaces and the abutment means at the respective tubular member, wherein said abutment means between the spring and the respective tubular members is configured so as to permit relative free movement of the tubular member abutment means in one direction away from the spring means, whereby the spring means acts only in one axial direction of the tubular members, wherein the tubular members are cylindrical in shape and permit relative rotational movement with respect to one another to further facilitate smooth operation of said device, and wherein at least one of said transverse holes is elongated in a direction parallel to the relative telescoping movement direction of the pivotal members to accommodate relative movement between the respective shaft means and the tubular members in the direction parallel to the relative telescoping movement direction for smooth operation of said device.

* * * * *